US009233040B2

(12) United States Patent
Matsubara et al.

(10) Patent No.: US 9,233,040 B2
(45) Date of Patent: Jan. 12, 2016

(54) INFANT INCUBATOR

(71) Applicant: ATOM MEDICAL CORPORATION, Bunkyo-ku, Tokyo (JP)

(72) Inventors: Kazuo Matsubara, Tokyo (JP); Terumi Matsubara, Saitama (JP); Shinichi Kobayashi, Saitama (JP); Kenji Kobayashi, Saitama (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 180 days.

(21) Appl. No.: 13/858,663

(22) Filed: Apr. 8, 2013

(65) Prior Publication Data

US 2013/0274543 A1 Oct. 17, 2013

(30) Foreign Application Priority Data

Apr. 11, 2012 (JP) ..... 2012-90486

(51) Int. Cl.
*A61G 11/00* (2006.01)

(52) U.S. Cl.
CPC ..... *A61G 11/001* (2013.01); *A61G 11/002* (2013.01); *A61G 11/005* (2013.01); *A61G 11/006* (2013.01); *A61G 11/009* (2013.01); *A61G 11/003* (2013.01)

(58) Field of Classification Search
USPC ..... 600/22
See application file for complete search history.

(56) References Cited

FOREIGN PATENT DOCUMENTS

JP 2010-99243 A 5/2010

*Primary Examiner* — Christine H Matthews
(74) *Attorney, Agent, or Firm* — Arent Fox LLP

(57) ABSTRACT

An infant incubator including: a left-side treatment door, a right-side treatment door, and an end-side treatment door which are rotatably held, and door-locking devices which fixes the left-side and right-side treatment doors on the end-side treatment door; the door-locking devices are formed from: open-close knobs each mounted rotatably on the left-side and right-side treatment doors and each having a hook-shaped distal end, and knob brackets each mounted on side of the end-side treatment doors having a hollow-shape, the infant incubator in which the treatment doors are fixed in a stand state by inserting the open-close knob into the knob bracket.

9 Claims, 14 Drawing Sheets

INFANT INCUBATOR

BACKGROUND OF THE INVENTION

1. Field of the Invention

The present invention relates to an infant incubator having two functions, both of an enclosed incubator in which an infant chamber is in a closed state and an open incubator in which an infant chamber is in an open state.

Priority is claimed on Japanese Patent Application No. 2012-90486, filed Apr. 11, 2012, the content of which is incorporated herein by reference.

2. Description of the Related Art

Japanese Unexamined Patent Application, First Publication No. 2010-99243 suggests a switchable infant incubator which can be switched as needed between states of an enclosed infant incubator and a closed infant incubator by moving up and down a canopy of a hood forming an infant chamber, in which the canopy is separated from a side wall of the hood.

In such a switchable infant incubator, the side wall of the hood is formed by four walls of left and right-side treatment doors which are disposed at the left-side and the right-side and end-side treatment doors which are disposed at the head side and the foot side. The side walls of the hood formed from those treatment doors of the four walls are fitted with the canopy, so that the enclosed infant incubator is formed. The left and right-side treatment doors and the foot-side treatment door can be open individually by turning down. Medical advices, treatments and the like for an infant can be operated from any sides by opening one or more treatment doors lateral of the infant chamber.

SUMMARY OF THE INVENTION

Problems to be Solved by the Invention

In open state of the infant incubator, the left and right-side treatment doors and the foot-side treatment door are open and closed when treating the infant. On the other hand, in closed state of the infant incubator, the left and right-side treatment doors are open and closed when treating the infant. Therefore, in the closed state, it is unnecessary to open and close the foot-side treatment door (i.e., the end-side treatment door); and further it is necessary not to enable the foot-side treatment door to carelessly be open and closed for maintaining environment in the infant chamber.

The present invention is achieved in consideration of the above circumstances, and has an object to provide an infant incubator in which an end-side treatment door of a hood can be surely locked when left and right-side treatment doors of the hood are locked in closed state; and the left and right-side treatment doors and the end-side treatment door of the hood can be easily open in open state.

Means for Solving the Problem

The present invention is an infant incubator having an infant chamber which can switch states between a closed state and an open state by opening and closing a hood, wherein: the hood includes a side wall part and a canopy which is separated from the side wall part and can be moved up and down, the side wall part includes: a left-side treatment door disposed at a left-side of an infant and a right-side treatment door disposed at a right-side of the infant, which are rotatably held between an erection state and open state; an end-side treatment door disposed at at least one of a head side or a foot side of the infant, which is rotatably held between the erection state and open state; and door-locking devices which lock the left-side treatment door and the right-side treatment door with the end-side treatment door with each other, each of the door-locking devices includes: an open-close knob which is attached to the left-side treatment door or the right-side treatment door and has a hook end; and a knob bracket which is attached to a side of the end-side treatment door and has a hollow portion to which the hook end is engaged, and the left-side treatment door and the right-side treatment door are fixed with the end-side treatment door in the erection state by engaging the hook end of the open-close knob and the hollow portion of the knob bracket.

Since the open-close knob has the hook end, the end-side treatment door can be locked using the door-locking devices of the left and right-side treatment doors although it is a simple mechanism, so that the end-side treatment door can be prevented from opening carelessly. Moreover, when the treatment doors are open, the left and right-side treatment doors and the end-side treatment door can be easily open by releasing the engagement of the open-close knob and the knob bracket.

Regarding the end-side treatment door, the head side and the foot side is set in accordance with a posture of the infant.

In the infant incubator according to the present invention, the canopy has a canopy gasket which is in contact with an top end portion of the end-side treatment door and maintains the canopy to close to the end-side treatment door in the closed state, the canopy gasket is provided with a vertical-wall portion having a sealing portion which is in contact with an inner surface of the end-side treatment door and a protruded ridge which is provided along an outer surface of the end-side treatment door, and the top end portion of the end-side treatment door is fitted between the vertical-wall portion and the protruded ridge in the closed state.

When the canopy and the treatment doors are closed, it is necessary to adjust positions of the canopy and the treatment doors accurately in order to maintain a sealing property of the infant chamber. Therefore, the canopy gasket which maintains the canopy to close to the end-side treatment door has the abovementioned vertical-wall portion and the protruded ridge so that the position of the canopy and the end-side treatment door can be adjusted. As a result, the positions of the canopy and the end-side treatment door can be adjusted, so that the gap between the canopy and the end-side treatment door can be surely sealed and maintained to be closed.

Furthermore, the end-side treatment door can be maintained in the erection state by the canopy gasket, so that the end-side treatment door is restricted to move to the open state, and it can be prevented to be open or closed improperly.

In the infant incubator according to the present invention, it is preferable that the canopy gasket be provided so that a part of the protruded ridge reaches to an outer periphery of an top end surface of the end-side treatment door.

In this case, the end-side treatment door is pressed toward inside an infant treatment room by the protruded ridge in the closed state, so that a sealing performance between the canopy and the end-side treatment door can be improved, and the end-side treatment door can be prevented from being open or closed improperly.

In the infant incubator according to the present invention, it is preferable that the canopy gasket be provided with a protruded portion at an outside of the protruded ridge so as to protrude higher than the protruded ridge.

By providing the protruded portion which is formed higher than the protruded ridge, a double wall is set with respect to the end-side treatment door. As a result, the end-side treatment door can be reliably prevented from being open or closed improperly.

Effects of the Invention

According to the infant incubator of the present invention, since the left-side and right-side treatment doors and the end-side treatment door share the door-locking device, the end-side treatment door can also be reliably locked when the left-side and the right-side treatment doors of the hood are locked in the closed state; and further, the left-side and the right-side treatment doors and the end-side treatment door of hood can be easily open in the open state, so that the operability can be improved. Also, in the closed state, the end-side treatment door is restricted to move to the open state, so that the end-side treatment door can be prevented from being open or closed improperly.

DETAILED DESCRIPTION OF THE INVENTION

Below, an embodiment of an infant incubator according to the present invention will be described.

[Total Construction of an Infant Incubator]

Figure 9:
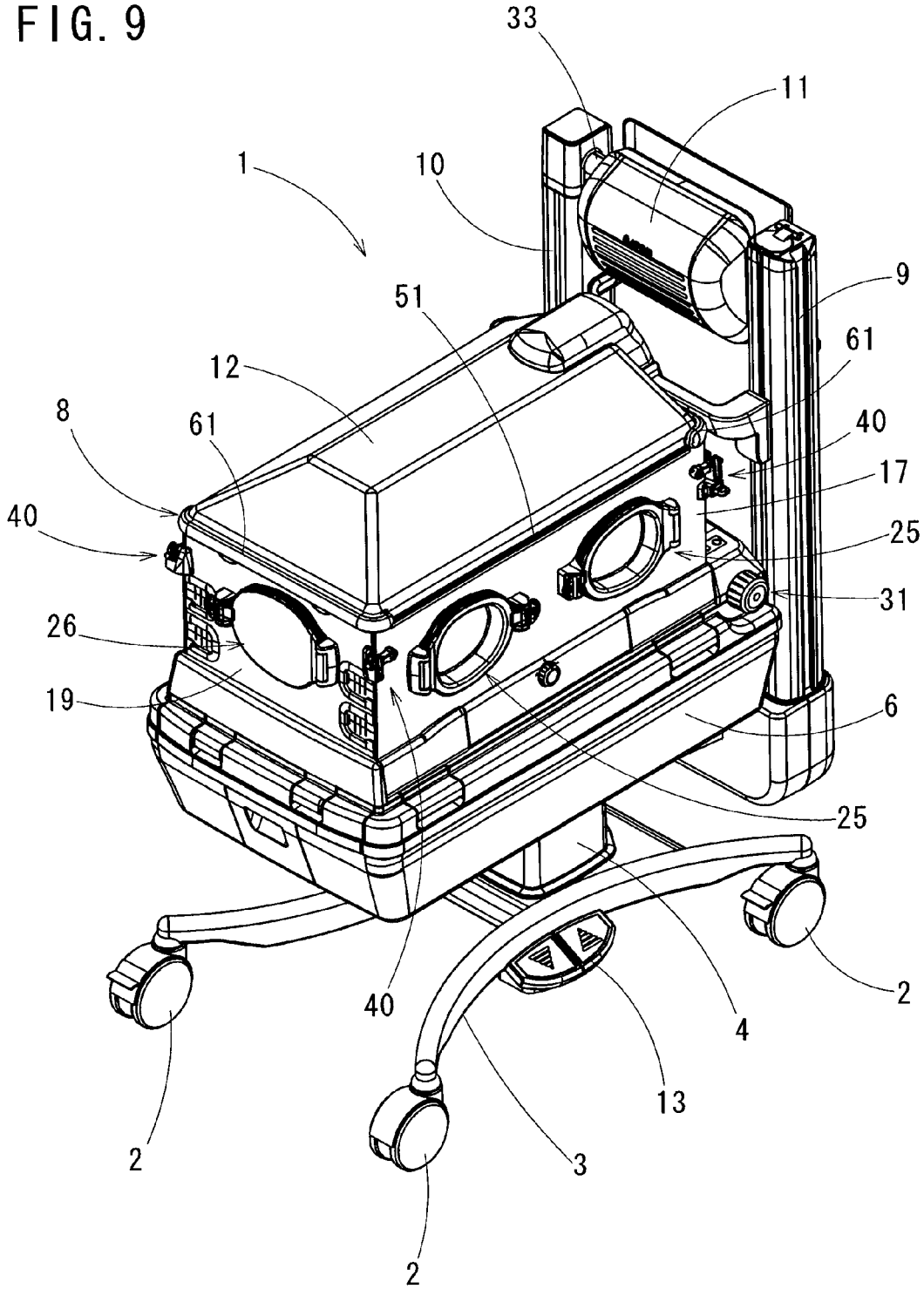
FIG. 9 is a perspective view showing an overall of the infant incubator.
Figure 10:
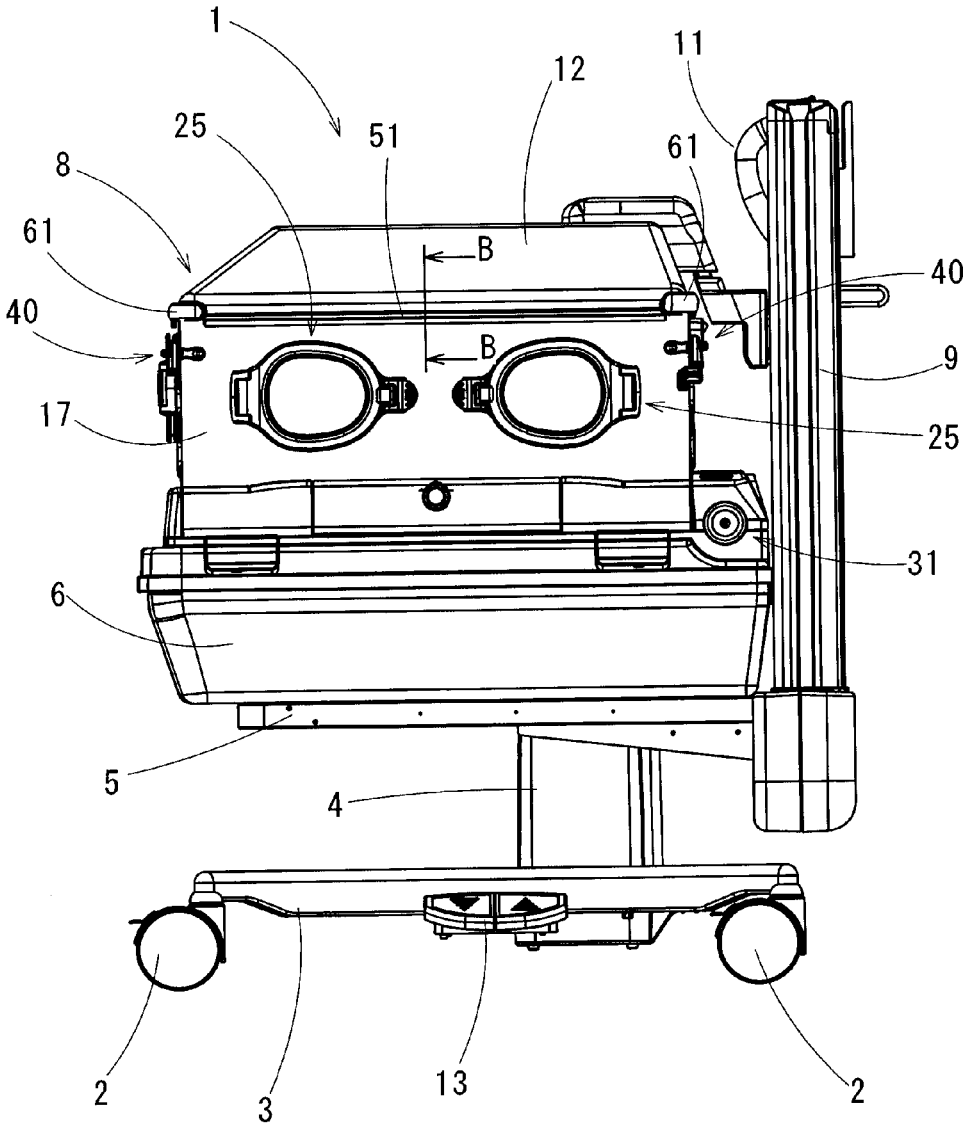
FIG. 10 is a front view showing the left-side treatment door of the infant incubator.
Figure 11:
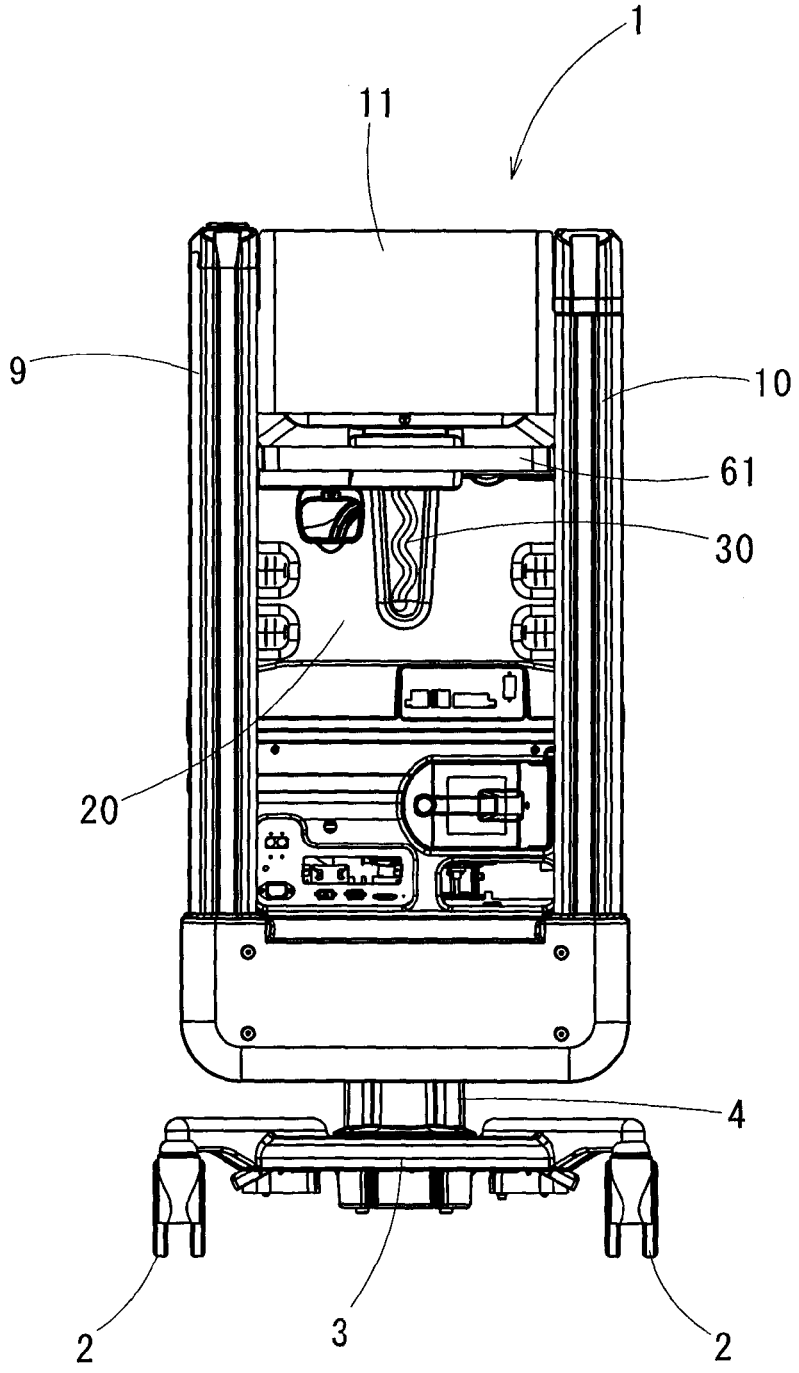
FIG. 11 is a right side view of FIG. 10.

As totally shown in FIGS. 9 to 11, an infant incubator 1 is provided with: a pedestal 3 which is movable by casters 2; a supporting post 4 which is vertically erected on the pedestal 3; a frame 5 which is provided at a top end of the supporting post 4; a base table 6 which is set on the frame 5; a hood 8 which is provided on the base table 6 and surrounds an infant chamber 7; two guide posts 9 and 10 which are vertically provided at an end portion of the frame 5 and both sides of the hood 8; a heater 11 which is provided at a top end of one of the guide posts (i.e., the guide post 10); and a canopy 12 which is set on a top end of the other of the guide posts (i.e., the guide post 9) and composes a roof of the hood 8.

The supporting post 4 internally has a lift which moves the frame 5 up and down. A pedal 13 is provided at a side of the pedestal 3 for operating the lift.

The hood 8 is constructed substantially rectangular of: a floor plate 16 in which a bed 15 for laying an infant down is mounted; a left-side treatment door 17 and a right-side treatment door 18 which are disposed each at a left side and a right side of the infant; a foot-side treatment door 19 which is disposed at a foot side of the infant; a head-side treatment door 20 which is disposed at a head side of the infant; and the canopy 12 which closes a top of the infant chamber 7 which is surrounded by the left-side and right-side treatment doors 17 and 18, the foot-side treatment door 19 and the head-side treatment door 20. The left-side treatment door 17, the right-side treatment door 18, the foot-side treatment door 19, the head-side treatment door 20 and the canopy 12 are substantially entirely formed from transparent resin, so that the infant in the infant chamber 7 can be checked with eyes from the outside.

Figure 13:
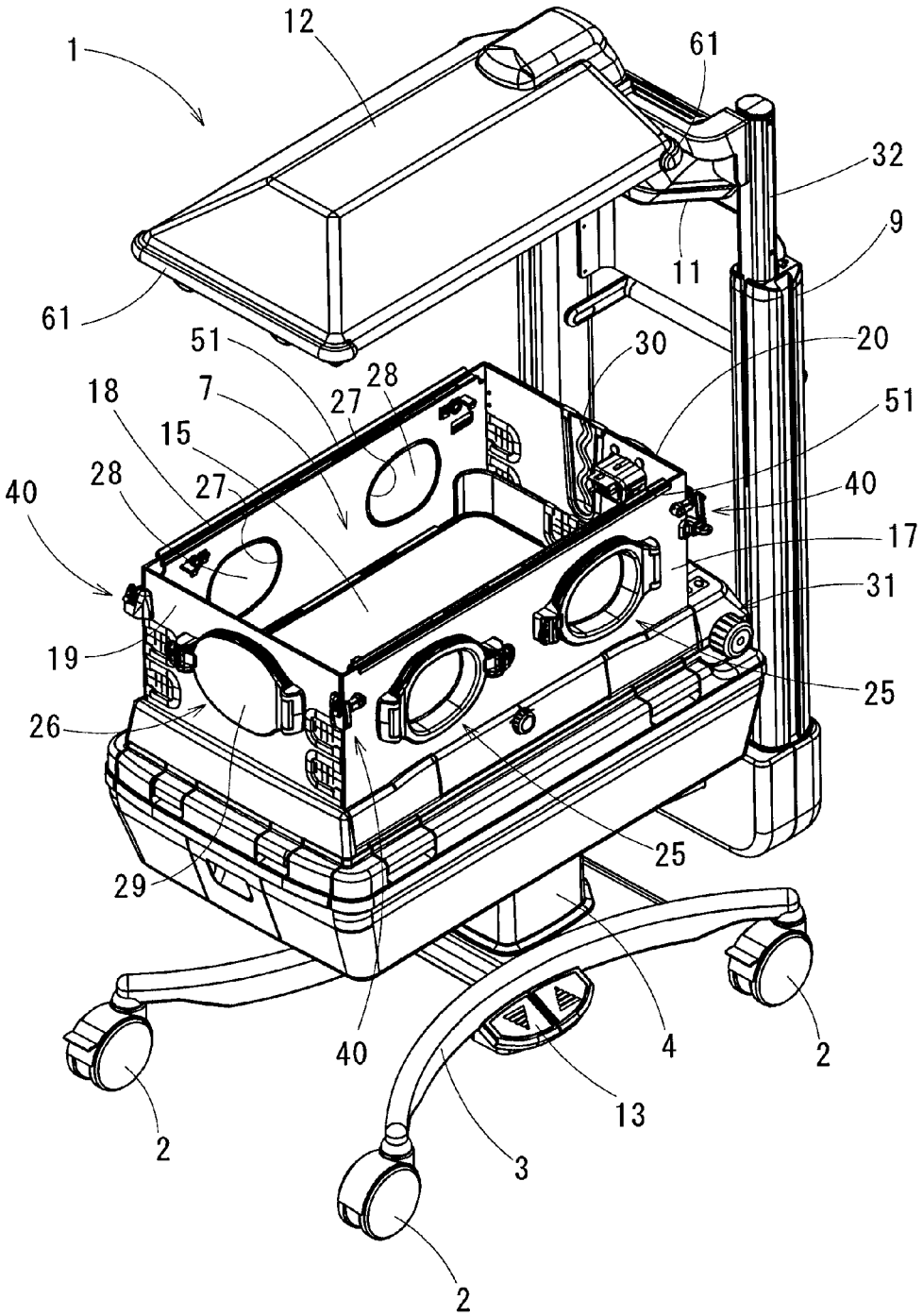
FIG. 13 is a perspective view showing a state in which the canopy and a heater are elevated in a state shown in FIG. 9.

FIGS. 9 to 11 show a state in which the hood 8 is closed by moving down the canopy 12; and FIG. 13 shows a state in which the top of the infant chamber 7 is open by moving up the canopy 12. Also, FIG. 13 shows a state in which the heater 11 is moved up and the infant chamber 7 is heated.

As described above, the infant incubator 1 has both the functions of forms of an enclosed incubator shown in FIGS. 9 to 11 and an open incubator shown in FIG. 13.

Figure 12:
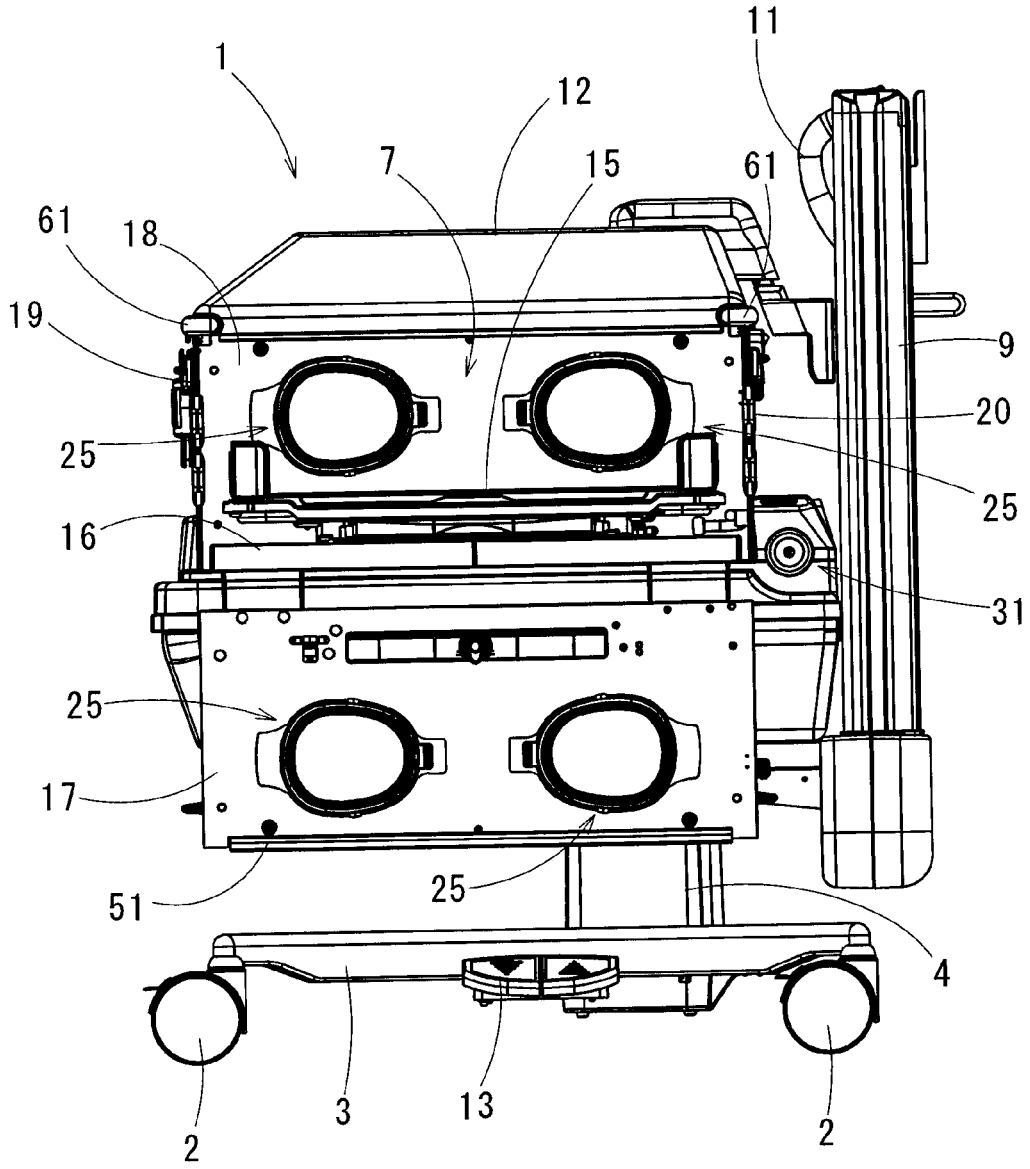
FIG. 12 is a front view showing a state in which the left-side treatment door is open in a state shown in FIG. 10.

Among the treatment doors 17 to 20, the head-side treatment door 20 is maintained in a vertical posture erecting at the head side of the infant chamber 7. On the other hand, lower ends of the left-side and right-side treatment doors 17 and 18 and the foot-side treatment door 19 are installed swingably around a horizontal shaft (not shown) with respect to the base table 6. In a case in which the infant incubator 1 is used as the enclosed incubator, the treatment doors 17 to 19 are closed, and the left-side and right-side treatment doors 17 and 18 can be open and closed for taking care of the infant. In FIG. 12, one side of the infant chamber 7 is open by turning the left-side treatment door 17 in the enclosed mode. In a case in which the infant incubator 1 is used as the open incubator, three sides of the infant chamber 7, i.e., the left-side treatment door 17, the right-side treatment door 18 and the foot-side treatment door 19 can be open and closed.

The left-side treatment door 17 and the right-side treatment door 18 have access-port units 25; and the foot-side treatment door 19 has an access-port unit 26. When the infant incubator 1 is used as the enclosed incubator, access ports 27 of the access-port units 25 and 26 can be open and closed by access flappers 28 of the access-port units 25 and an access flapper 29 of the access-port unit 26 while the treatment doors 17 to 19 remain standing. The head-side treatment door 20 is provided with grommet members 30 having slits through which cables or tubes are inserted.

On the floor plate 16 in the infant chamber 7, the bed 15 on which the infant is laid is provided. The bed 15 is swingably held at a center of a longitudinal direction by a horizontal shaft (not illustrated) and an end portion of the head side is held by a lift 31. By elevating the end portion which is held by the lift 31, the bed 15 can be held a position which is inclined to the horizontal direction. The lift 31 is provided at an outside of the hood 8.

The guide posts 9 and 10 each have a coaxial rod 32 and a lift which moves up and down the rod 32 therein. The canopy 12 is attached to an upper end of the rod 32, can close the infant chamber 7 at a down position thereof by being in contact with upper ends of the treatment doors 17 to 20, and can retract from the treatment doors 17 to 20 at an upper position thereof at an enough distance for treatments for the infant. The heater 11 is attached to an upper end of a rod (not illustrated, but provided as the guide post 9 shown in FIG. 13) of the other guide post 10 rotatably around a horizontal shaft 33. The heater 11 has: a folding position at a down position by folding vertically and substantially parallel to the guide post 10 as shown in FIG. 9 and so forth; and a heating position at an elevated position for supplying heat wave from above to the infant chamber 7 by raising with a subscribed angle with respect to the vertical direction.

[Construction of Door-Locking Device]

Door-locking devices 40 each are provided at the left-side treatment door 17, the right-side treatment door 18, the foot-side treatment door 19 so as to fix the foot-side treatment door 19 with the left-side treatment door 17 and the right-side treatment door 18 in a state in which the treatment doors 17 to 19 are erected.

Figure 1:
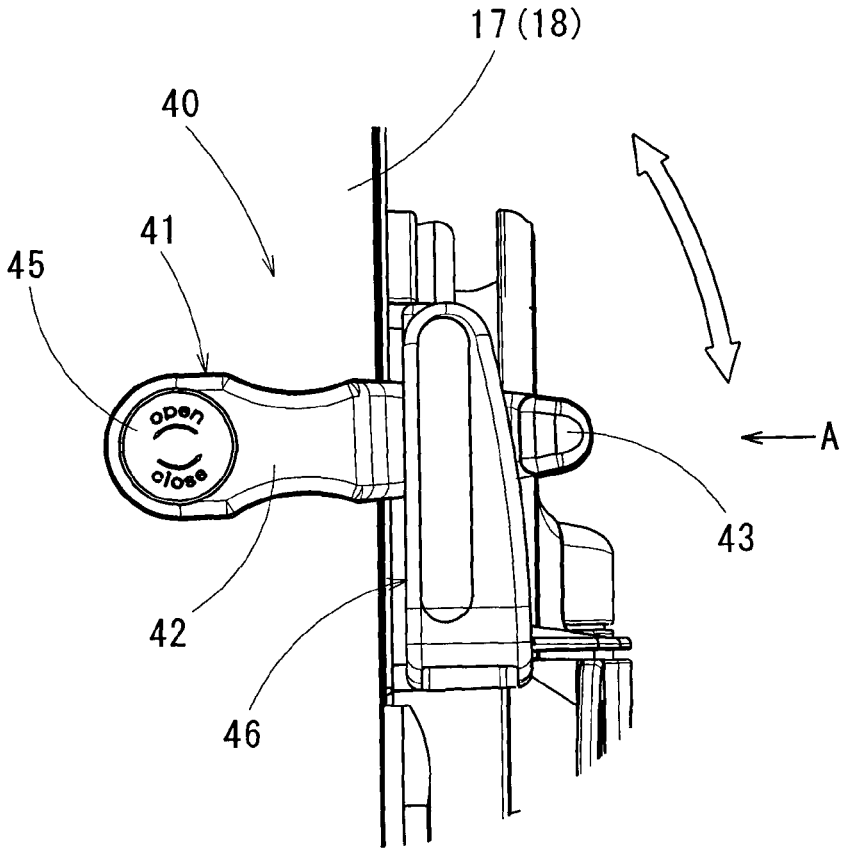
FIG. 1 is a front view showing a door-locking device in an infant incubator of an embodiment according to the present invention.
Figure 2:
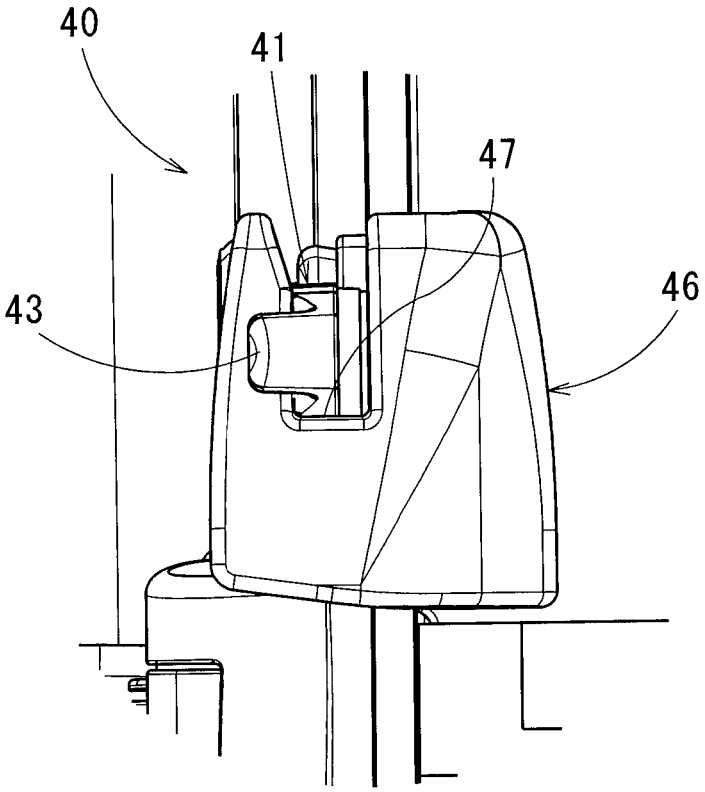
FIG. 2 is a side view of the door-locking device taken from the direction A of FIG. 1.

As shown in FIG. 1 and FIG. 2, the door-locking devices 40 each are formed from an open-close knob 41 which is rotatably attached to the left-side treatment door 17 and the right-side treatment door 18, and a knob bracket 46 which is fixed to each side of the foot-side treatment door 19.

Figure 3:
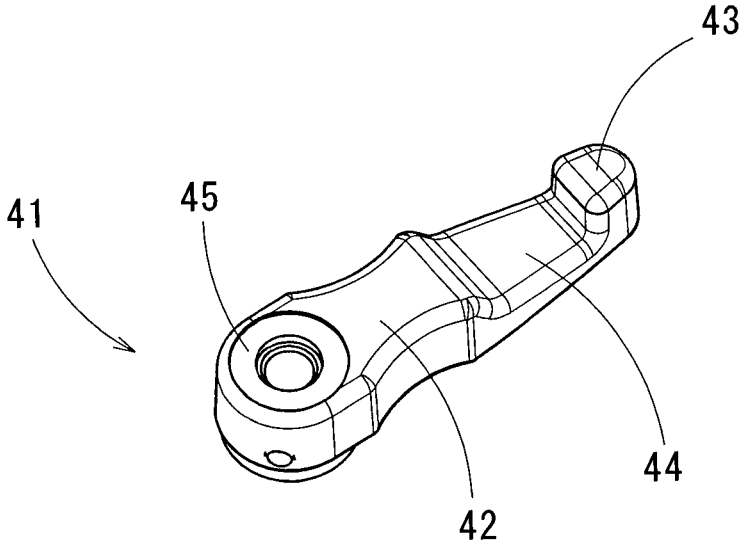
FIG. 3 is a perspective view of an open-close knob.

The open-close knob 41 is, as shown in FIG. 1 and FIG. 3, formed from a hook portion 43 which is protruded perpendicularly from each surface of the left-side and right-side treatment doors 17 and 18 and a thin-walled portion which is hooked on the knob bracket 46, so that the hook portion 43 and the thin-walled portion 44 are formed integrally at an end portion of a lever portion 42 which is parallel to each surface of the left-side and right-side treatment doors 17 and 18. A base-end portion 45 of the lever portion 42 is held by a pin to the left-side and right-side treatment doors 17 and 18 rotatably along each surface of the left-side and right-side treatment doors 17 and 18. By inserting the thin-walled portion 44 of the open-close knob 41 into a hollow portion 47 of the knob bracket 46 and protruding the hook portion 43 from the knob bracket 46 so as to hook a side surface of the knob bracket 46, the left-side treatment door 17, the right-side treatment door 18 and the foot-side treatment door 19 are inhibited from rotating, so that the treatment doors 17 to 19 are fixed each other to standing states.

[Configuration of Treatment-Door Gasket and Canopy Gasket]

Figure 4:
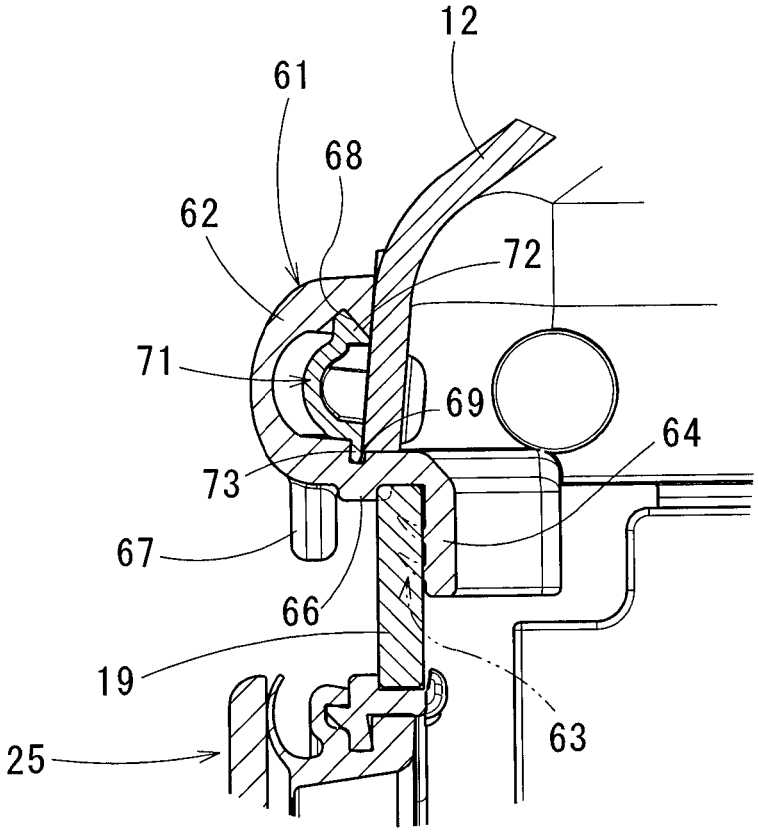
FIG. 4 is a sectional view of a sealing portion between a foot-side treatment door and a canopy taken along the B-B line of FIG. 10.
Figure 7:
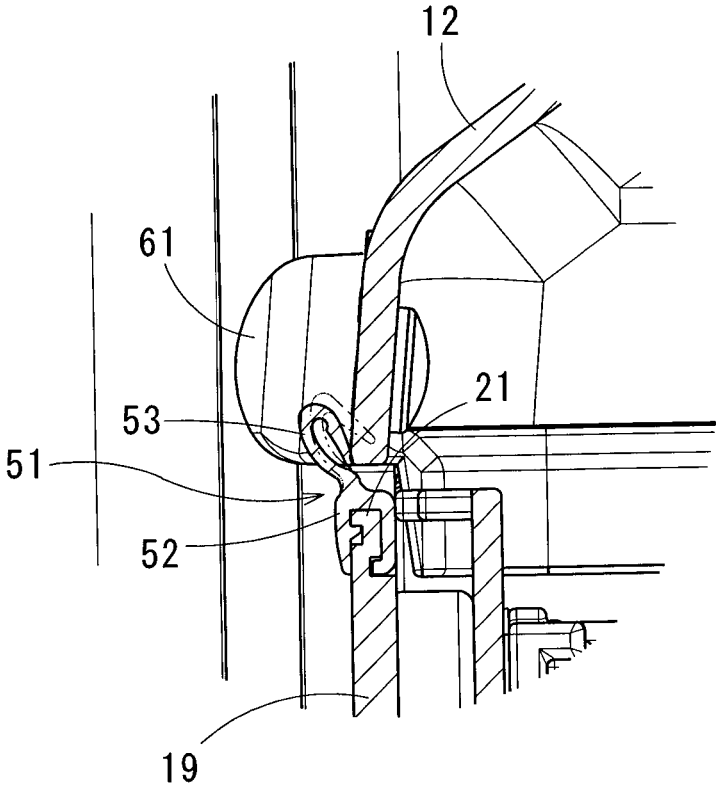
FIG. 7 is a sectional view showing a sealing portion between a left-side treatment door and the canopy taken along the line C-C of FIG. 14.

A treatment-door gasket 51 and a canopy gasket 61 are provided between the treatment doors 17 to 20 and the canopy 12 of the hood 8 so as to hold the treatment doors 17 to 20 and the canopy 12 in a closed state when the canopy 12 is moved down so as to be set to the closed state. The treatment-door gasket 51 is, as shown in FIG. 7, mounted on each top end of the left-side treatment door 17 and the right-side treatment door 18 between the canopy 12 and the left-side and right-side treatment doors 17 and 18 in the closed state. The canopy gasket 61 is, as shown in FIG. 4, mounted on a front surface and a back surface of the canopy 12 with inserting a canopy frame 71 therebetween, and is disposed between the foot-side treatment door 19 and the canopy 12 and between the head-side treatment door 20 and the canopy 12.

Figure 8:
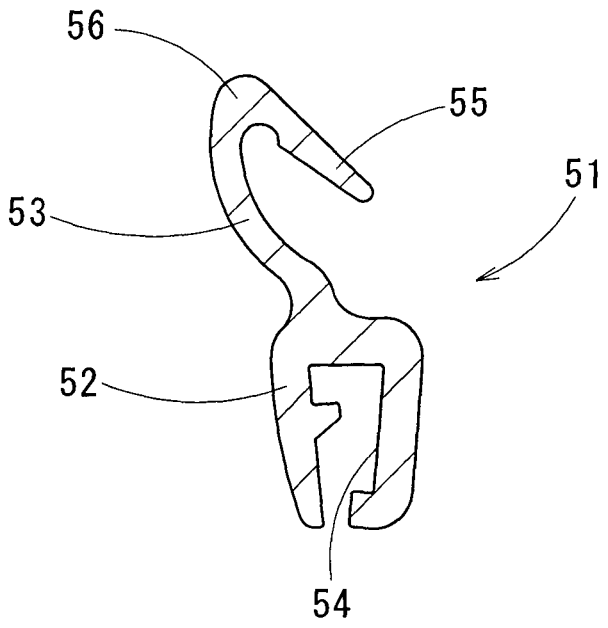
FIG. 8 is a cross sectional view showing a treatment door gasket.

The treatment-door gasket 51 is, shown as FIGS. 7 and 8, formed integrally from a fixing portion 52 having a U-shape in section which is fixed along each top ends of the left-side treatment door 17 and the right-side treatment door 18; a sealing portion 53 which extends from the fixing portion 52. A hollow groove 54 is formed at the fixing portion 52 so as to fit and to cover a protruded ridge 21 which is formed at each top ends of the treatment doors 17 and 18. The sealing portion 53 is formed as a thin-walled belt-plate, is bent at a distal-end portion 55 thereof inwardly and downwardly, and is protruded upwardly at a bulge portion 56. The sealing portion 53 is in contact with an outer peripheral surface of the canopy 12 at an inner peripheral surface of the distal-end portion 55 which is bended inwardly and downwardly in a state in which the left-side treatment door 17 and the right-side treatment door 18 are closed with respect to the canopy 12, so that a gap between the left-side treatment door 17 and the canopy 12 and a gap between the right-side treatment door 18 and the canopy 12 are sealed. As a result, the left-side treatment door 17 and the right-side treatment door 18 can be open and closed in a state in which the canopy 12 is closed.

The same canopy gaskets 61 are mounted on the foot-side treatment door 19 and the head-side treatment door 20. As described above, the head-side treatment door 20 is constructed to stand so as not to move. Below, the foot-side treatment door 19 will be described.

The canopy frame 71 is formed to have a bar-shape along a lower end portion of the canopy 12, mounted to the lower end portion by screws or the like, and has an arc-shape in section. Protruded ridges 72 and 73 are each formed at both sides of the canopy frame 71 so as to be inserted into the canopy gasket 61.

Figure 5:
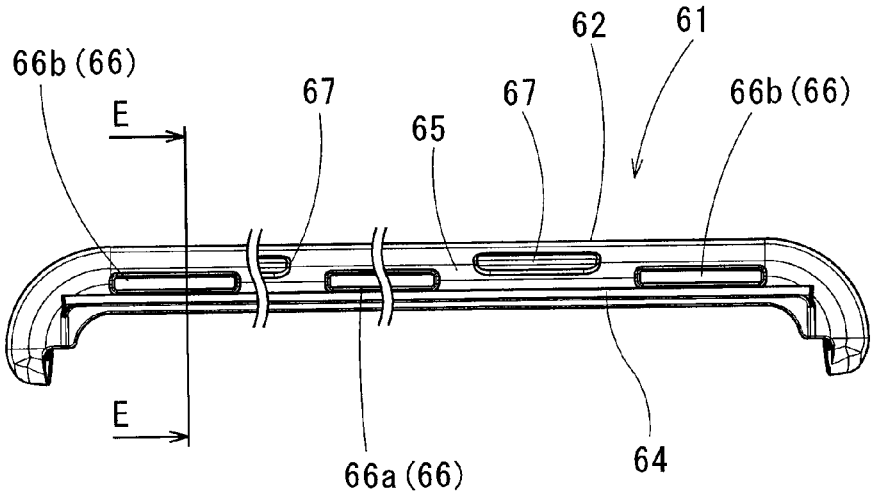
FIG. 5 is a back view showing a canopy gasket taken from the D direction of FIG. 14.
Figure 6:
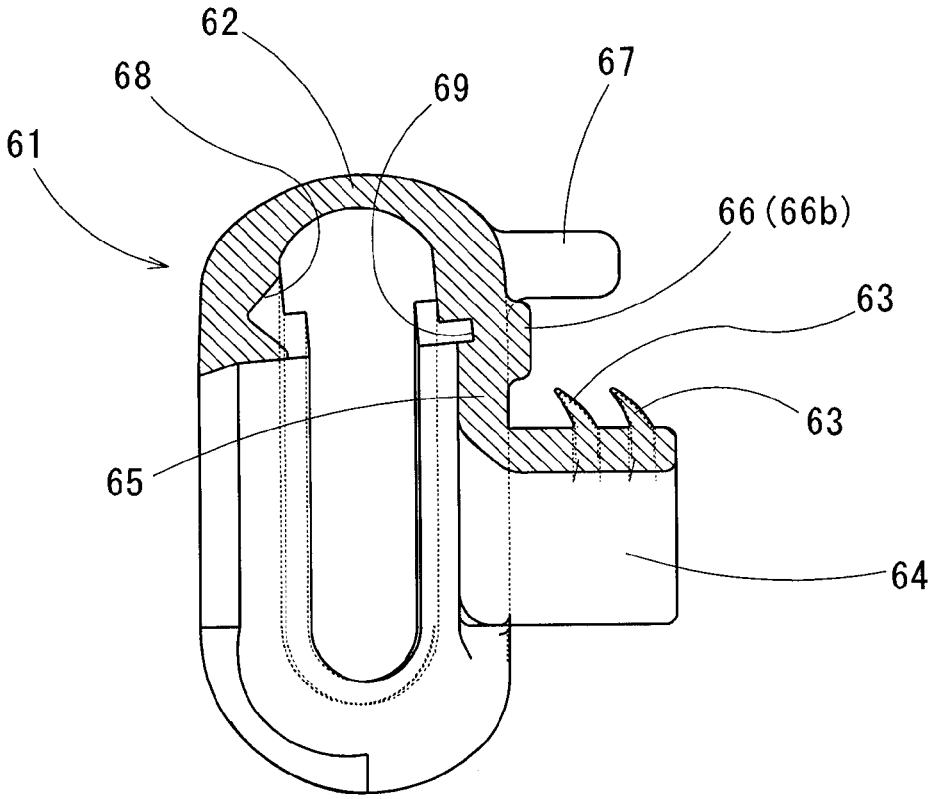
FIG. 6 is a cross sectional view showing the canopy gasket taken along the line D-D of FIG. 5.

As shown in FIGS. 4 to 6, a fixing portion 62 which is fixed along the canopy frame 71 and has an arc-shape in section; a vertical-wall portion 64 having a sealing portion 63 which is in contact with an inner surface of the foot-side treatment door 19; a connecting portion 65 which connects the fixing portion 52 and the vertical-wall portion 64; a protruded-ridge portion 66 which is provided along an outer surface of the foot-side treatment door 19; and protruded portions 67 which protrude higher than the protruded-ridge portion 66 at the outside of the protruded-ridge portion 66 are formed integrally in the canopy gasket 61.

Figure 14:
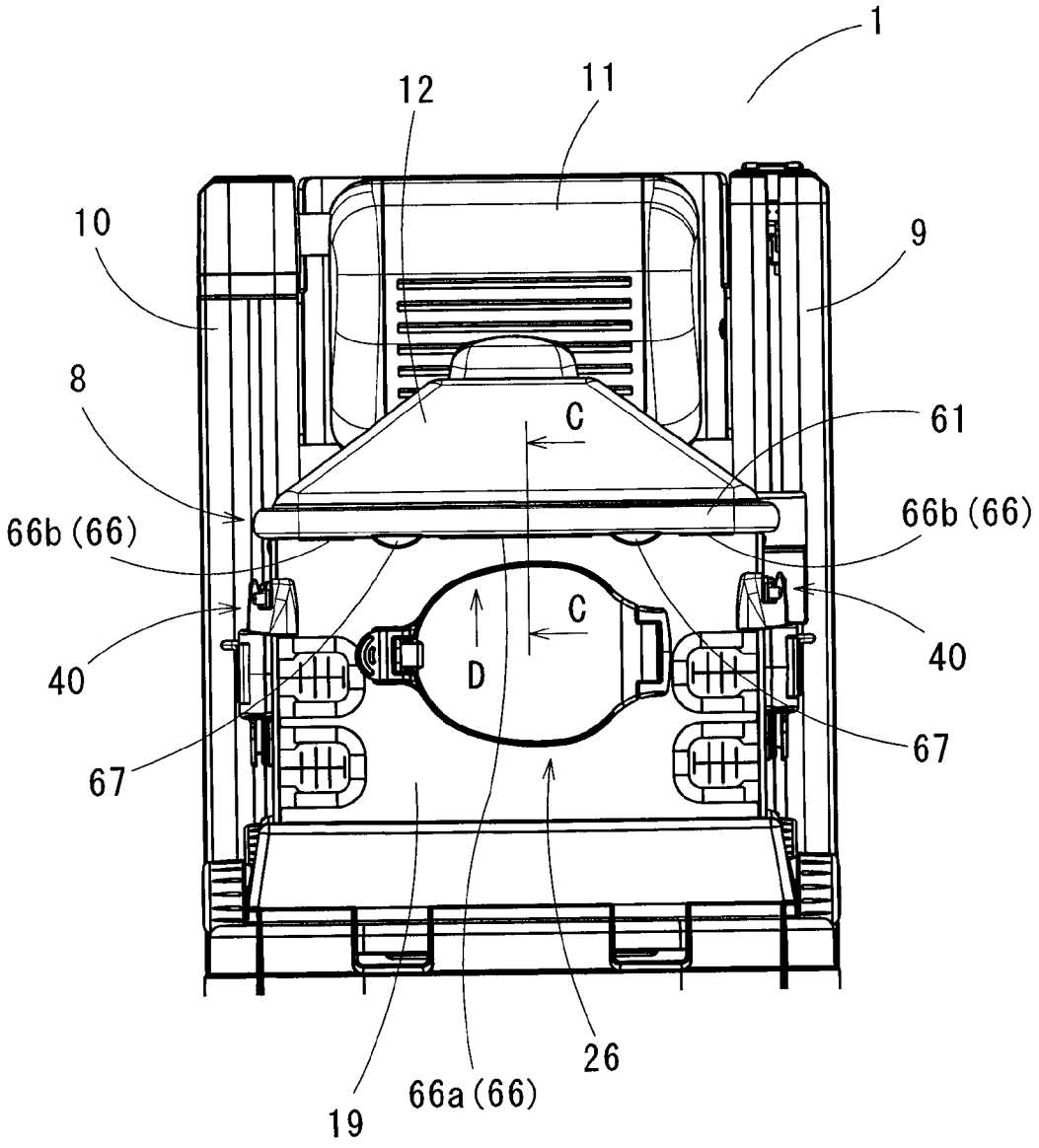
FIG. 14 is a left-side view showing the incubator in FIG. 10 but a lower part than a base table in FIG. 10 is omitted.

A hollow groove 68 in which the protruded ridge 72 of the canopy frame 71 is inserted is formed at an upper end portion of an arc-shaped inner peripheral portion of the fixing portion 62 so that the fixing portion 62 covers the canopy frame 71. Also, hollow groove 69 in which the protruded ridge 73 of the canopy frame 71 is inserted is formed at a lower end portion of the arc-shaped inner peripheral portion of the fixing portion 62 so that the fixing portion 62 covers the canopy frame 71. The sealing portion 63 having upper and lower two-tiered shape is formed integrally to the vertical-wall portion 64 so as to extend obliquely upward. The sealing portions 63 are in contact with the inner surface of the foot-side treatment door 19 in the closed state so as to seal between the foot-side treatment door 19 and the canopy 12. In the protrude-ridge portion 66, a distance to the vertical-wall portion 64 is smaller than a thickness of a wall of the foot-side treatment door 19; and a part of the protruded-ridge portion 66 covers the outer peripheral edge of the top end surface of the foot-side treatment door 19. As shown in FIG. 5 and FIG. 14, three protruded-ridge portions 66 are formed along the outer peripheral surface of the foot-side treatment door 19. Further, the protruded-ridge portion **66*a* which is disposed at the center of the tree protruded-ridge portions 66 is formed longer than the protruded-ridge portions 66*b* which are disposed at both sides thereof. The two protruded portions 67 are each disposed between the center protruded-ridge portion 66*a* and the protruded-ridge portions 66*b* at the both sides of the center protruded-ridge portion 66*b***.

The canopy gasket 61 is formed so that the upper end portion of the foot-side treatment door 19 is fitted between the vertical-wall portion 64 and the protruded-ridge portion 66, when the canopy 12 is moved down so that the hood 8 is closed (i.e., the closed state). As a result, the canopy gasket 61 aligns the canopy 12 and the foot-side treatment door 19 and seals between the canopy 12 and the foot-side treatment door 19. In this case, the foot-side treatment door 19 is kept standing by the canopy gasket 61. Moreover, when the fixations by the door-locking devices 40 are cancelled so that the left-side and right-side treatment doors 17 and 18 are in the open state, the foot-side treatment door 19 is restricted not to move to the opening direction. Furthermore, since the part of the protruded-ridge portion 66 covers the outer peripheral edge of the top end surface of the foot-side treatment door 19, the foot-side treatment door 19 is pressed toward the inside of the infant chamber 7, so that the sealing property between the vertical-wall portion 64 of the canopy gasket 61 and the foot-side treatment door 19 can be improved.

[Open-and-Close Operation of the Treatment Door]

As shown in FIG. 13, the open-and-close operation of the left-side treatment door 17, the right-side treatment door 18, and the foot-side treatment door 19 in a case in which the canopy 12 is moved up and the infant chamber 7 is in open state will be described.

When the left-side treatment door 17, the right-side treatment door 18, and the foot-side treatment door 19 are open from the state in which the treatment doors 17 to 20 are closed by the door-locking devices 40, as shown by an outlined allow in FIG. 1, the hook portion 43 of the open-close knob 41 of the door-locking device 40 is rotated so as to point upward (rotated counterclockwise in FIG. 1) so that the lever portion 42 of the open-close knob 41 is unfastened from the inside of the knob bracket 46. As a result, the left-side treatment door 17 and the foot-side treatment door 18 are unfixed to the foot-side treatment door 19. Then, the treatment doors 17 to 19 are open by rotating the treatment doors 17 to 19.

In order to recover the treatment doors 17 to 19 to the stand state, by inverse operation to the abovementioned operation, the treatment doors 17 to 19 are stood; the lever portion 42 of the open-close knob 41 is inserted into the hollow portion 47 of the knob bracket 46; and the hook portion 43 is protruded from the knob bracket 46 so as to be held by hooking a side surface of the knob bracket 46. As a result, the left-side treatment door 17 and the right-side treatment door 18 are prevented from rotating, and also the foot-side treatment door 19 is prevented from rotating, so that the treatment doors 17 to 19 are fixed in the stand state with each other. Therefore, the foot-side treatment door 19 can be reliably locked when the left-side and right-side treatment doors 17 and 18 are locked.

As described above, by forming the top end of the open-close knob 41 as a hook-shape, the foot-side treatment door 19 can be locked and is prevented from being open improperly by utilizing the door-locking devices 40 of the left-side and right-side treatment door 17 and 18 even though it is a simple mechanism. Moreover, the left-side and right-side treatment door 17 and 18 and the foot-side treatment door 19 can be easily open by canceling the fitting of the open-close knob 41 and the knob bracket 46 when the treatment door 17 to 19 are open.

[Open-and-Close Operation of Canopy]

It will be described that the infant camber 7 is switched to closed state by moving down the canopy 12 as shown in FIG. 9 from the state in which the canopy 12 is moved up so as to open the upper part of the infant chamber 7 as shown in FIG. 13.

In the state in which the treatment doors 17 to 20 are closed by the door-locking devices 40, if the canopy 12 is moved down, the canopy gaskets 61 which are attached to the canopy 12 are moved along with the canopy 12, so that the canopy gaskets 61 are each disposed between the foot-side treatment door 19 and the canopy 12 and the head-side treatment door 20 and the canopy 12. In this case, the upper end portion of the foot-side treatment door 19 is fit inserted between the vertical-wall portion 64 and the protruded-ridge portion 66 both are provided at the canopy gasket 61, so that the canopy 12 and the foot-side treatment door 19 are aligned and a gap between the canopy 12 and the foot-side treatment door 19 is sealed.

The gap between the canopy 12 and the left-side treatment door 17 is sealed by the treatment-door gasket 51 which is mounted on the left-side treatment door 17. Also, the gap between the canopy 12 and the right-side treatment door 18 is sealed by the treatment-door gasket 51 which is mounted on the right-side treatment door 18. The sealing portion 53 of the treatment-door gasket 51 is formed so as to protrude upward at the bulge portion 56. The distal-end portion 55 is pressed outward along with moving down of the canopy 12 and kept being in contact with the outer peripheral surface of the canopy 12, so that the gap between the left-side treatment door 17 and the canopy 12 and the gap between the right-side treatment door 18 and the canopy 12 are sealed.

Next, the open-close operation of the left-side treatment door 17 and the right-side treatment door 18 in the closed state of the infant chamber 7 will be described.

As shown by the outlined allow in FIG. 1, by rotating the hook portion 43 of the open-close knob 41 of the door-locking device 40 so as to point upward (rotated counterclockwise in FIG. 1), so that the lever portion 42 of the open-close knob 41 is unfastened from the inside of the knob bracket 46. As a result, the left-side treatment door 17 and the foot-side treatment door 18 are unfixed to the foot-side treatment door 19 and the head-side treatment door 20. In this case, the foot-side treatment door 19 is kept standing since the upper end portion thereof is fixed by the canopy gasket 61, even though the foot-side treatment door 19 is unfixed to the left-side treatment door 17 and the right-side treatment door 18. In this state, by rotating the left-side treatment door 17 and the right-side treatment door 18, the treatment doors 17 and 18 can be open. FIG. 12 shows a state in which only the left-side treatment door 17 is open.

Then, in order to recover the left-side treatment door 17 and the right-side treatment door 18 to the stand state, by inverse operation to the abovementioned operation, the treatment doors 17 and 18 are stood; the lever portion 42 of the open-close knob 41 is inserted into the hollow portion 47 of the knob bracket 46; and the hook portion 43 is protruded from the knob bracket 46 so as to be held by hooking a side surface of the knob bracket 46. In the closed state of the left-side treatment door 17 and the right-side treatment door 18, the inner peripheral surface of the distal-end portion 55 of the treatment-door gasket 51 is in contact with the outer peripheral surface of the canopy 12, so that the gap between the left-side treatment door 17 and the canopy 12 and the gap between the right-side treatment door 18 and the canopy 12 are sealed.

As described above, the foot-side treatment door 19 can be held to stand when the fixation of the left-side treatment door 17 to the foot-side treatment door 19 and the fixations of the right-side treatment door 18 to the foot-side treatment door 19 by the door-locking devices 40 are cancelled. Therefore, the foot-side treatment door 19 is restricted not to move to the opening direction in the closed state of the canopy 12, so that the foot-side treatment door 19 can be prevented from being open improperly. Moreover, since the protruded portions 67 which protrude higher than the protruded-ridge portion 66 at the outside of the protruded-ridge portion 66 of the canopy gasket 61, the foot-side treatment door 19 can be reliably prevented from being open improperly in the closed state.

The present invention is not limited to the above-described embodiments and various modifications may be made without departing from the scope of the present invention.

In the above embodiment, the foot-side treatment door 19 and the head-side treatment door 20 are disposed with respect to the left-side and right-side treatment doors 17 and 18 as shown in FIG. 9 and the like. However, it can be supposed to be used with reversing the foot side and the head side according to the position of the infant in the infant chamber 7. In this case, the foot-side treatment door 19 on which the access-port unit 26 is mounted is at the head side of the infant.

In the above embodiment, the reference symbol 19 represents the foot-side treatment door, and the reference symbol 20 represents the head-side treatment door. However, since a case in which the reference symbol 20 represents the foot-side treatment door can be supposed, the foot-side treatment door and the head-side treatment door are designated as the end-side treatment doors.

What is claimed is:

1. An infant incubator comprising an infant chamber which can switch states between a closed state and an open state by opening and closing a hood, wherein:

the hood comprises a side wall part and a canopy which is separated from the side wall part and wherein the canopy can be moved up and down, the side wall part comprises: a left-side treatment door configured to be disposed at a left side of an infant and a right-side treatment door configured to be disposed at a right side of the infant, which are rotatably held between an erection state and open state; an end-side treatment door configured to be disposed at at least one of a head side or a foot side of the infant, which is rotatably held between an erection state and open state; and a door-locking device which locks the left-side treatment door and the right-side treatment door with respective sides of the end-side treatment door, wherein the door-locking device comprises: an open-close knob comprising a hook end, which is attached to the left-side treatment door or the right-side treatment door; and a knob bracket comprising a hollow portion to which the hook end is engaged, which is attached to a side of the end-side treatment door, and the left-side treatment door and the right-side treatment door are fixed with the end-side treatment door in the erection state by engaging the hook end of the open-close knob and the hollow portion of the knob bracket.

2. The infant incubator according to claim 1, wherein the canopy has a canopy gasket which is in contact with a top end portion of the end-side treatment door and maintains the canopy to close the end-side treatment door in the closed state, the canopy gasket is provided with a vertical-wall portion having a sealing portion which is in contact with an inner surface of the end-side treatment door and a protruded ridge which is provided along an outer surface of the end-side treatment door, and the top end portion of the end-side treatment door is fitted between the vertical-wall portion and the protruded ridge in the closed state.

3. The infant incubator according to claim 2, wherein the canopy gasket is provided so that a part of the protruded ridge reaches to an outer periphery of a top end surface of the end-side treatment door.

4. The infant incubator according to claim 2, wherein the canopy gasket is provided with a protruded portion at an outside of the protruded ridge so as to protrude higher than the protruded ridge.

5. An infant incubator comprising an infant chamber which can switch states between a closed state and an open state by opening and closing a hood, wherein:

the hood comprises a side wall part and a canopy which is separated from the side wall part and wherein the canopy can be moved up and down, the side wall part configured for receiving an infant comprises:

a left-side treatment door configured to be disposed at a left side of the infant and a right-side treatment door configured to be disposed at a right side of the infant, which are rotatably held between an erection state and open state; an end-side treatment door configured to be disposed at at least one of a head side or a foot side of the infant, which is rotatably held between an erection state and open state; and a door-locking device which locks the left-side treatment door and the right-side treatment door with respective sides of the end-side treatment door, wherein the door-locking device comprises: an open-close knob which is attached to the left-side treatment door or the right-side treatment door and has a hook end; and a knob bracket which is attached to a side of the end-side treatment door and has a hollow portion to which the hook end is engaged, and the left-side treatment door and the right-side treatment door are fixed with the end-side treatment door in the erection state by engaging the hook end of the open-close knob and the hollow portion of the knob bracket.

6. The infant incubator according to claim 5, wherein the canopy has a canopy gasket which is in contact with a top end portion of the end-side treatment door and maintains the canopy to close the end treatment door in the closed state, the canopy gasket is provided with a vertical-wall portion having a sealing portion which is in contact with an inner surface of the end treatment door and a protruded ridge which is provided along an outer surface of the end treatment door, and the top end portion of the end treatment door is fitted between the vertical-wall portion and the protruded ridge in the closed state.

7. The infant incubator according to claim 6, wherein the canopy gasket is provided so that a part of the protruded ridge reaches to an outer periphery of a top end surface of the end treatment door.

8. The infant incubator according to claim 6, wherein the canopy gasket is provided with a protruded portion at an outside of the protruded ridge so as to protrude higher than the protruded ridge.

9. An infant incubator comprising an infant chamber which can switch states between a closed state and an open state by opening and closing a hood, wherein:

the hood comprises a side wall part and a canopy which is separated from the side wall part and wherein the canopy can be moved up and down, the side wall part comprises: a first-side treatment door disposed at a first-side and a second-side treatment door disposed at a second side, which are rotatably held between an erection state and open state; an end treatment door disposed at at least one of a third side or a fourth side, which is rotatably held between an erection state and open state; and a door-locking device which locks the first-side treatment door and the second-side treatment door with respective sides of the end treatment door, wherein the door-locking device comprises: an open-close knob which is attached to the first-side treatment door or the second-side treatment door and has a hook end; and a knob bracket which is attached to a side of the end treatment door and has a hollow portion to which the hook end is engaged, and the first-side treatment door and the second-side treatment door are fixed with the end treatment door in the erection state by engaging the hook end of the open-close knob and the hollow portion of the knob bracket.

* * * * *